US010122140B1

(12) United States Patent
Vega-Perez

(10) Patent No.: US 10,122,140 B1
(45) Date of Patent: Nov. 6, 2018

(54) LIGHT FIXTURE APPARATUS

(71) Applicant: Javier F. Vega-Perez, Camuy, PR (US)

(72) Inventor: Javier F. Vega-Perez, Camuy, PR (US)

( * ) Notice: Subject to any disclaimer, the term of this patent is extended or adjusted under 35 U.S.C. 154(b) by 0 days.

(21) Appl. No.: 15/461,988

(22) Filed: Mar. 17, 2017

Related U.S. Application Data

(60) Provisional application No. 62/310,685, filed on Mar. 19, 2016, provisional application No. 62/310,741, filed on Mar. 20, 2016.

(51) Int. Cl.

| | |
|---|---|
| ***H01R 13/66*** | (2006.01) |
| ***H01R 33/88*** | (2006.01) |
| ***F21V 23/06*** | (2006.01) |
| ***H01R 31/02*** | (2006.01) |
| ***H01R 33/22*** | (2006.01) |

(52) U.S. Cl.
CPC ..... *H01R 33/88* (2013.01); *F21V 23/06* (2013.01); *H01R 31/02* (2013.01); *H01R 33/22* (2013.01)

(58) Field of Classification Search
CPC ..... H01R 33/88; H01R 31/02; H01R 33/22; F21V 23/06
USPC ..... 439/339, 535, 537, 540.1
See application file for complete search history.

(56) References Cited

U.S. PATENT DOCUMENTS

| | | | | |
|---|---|---|---|---|
| 4,565,419 | A * | 1/1986 | Johnson | H01R 33/94 439/641 |
| 5,664,872 | A * | 9/1997 | Spearman | F21V 29/02 362/294 |
| 6,250,780 | B1 * | 6/2001 | Minissi | F21S 8/02 362/147 |
| 6,648,488 | B1 * | 11/2003 | Pearce | F04D 25/088 362/147 |
| 7,247,049 | B2 * | 7/2007 | Ratican | H01R 33/94 439/236 |
| 7,628,504 | B2 * | 12/2009 | Glickman | F21S 8/06 362/147 |

* cited by examiner

*Primary Examiner* — Khiem Nguyen
(74) *Attorney, Agent, or Firm* — Luis Figarella

(57) ABSTRACT

A light fixture apparatus, system and method that allows the easy retrofitting of recessed and non-recessed mechanical and electrical outlets for lamps, projectors and ceiling fans; providing electrical interconnectivity and mechanical support. It includes a housing, single or multi-threads for mechanical mounting and support as well as the electrical interfaces.

5 Claims, 19 Drawing Sheets

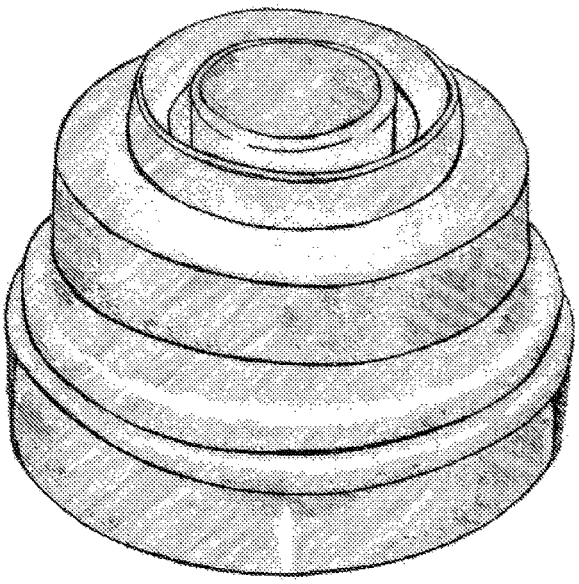
Figure 16
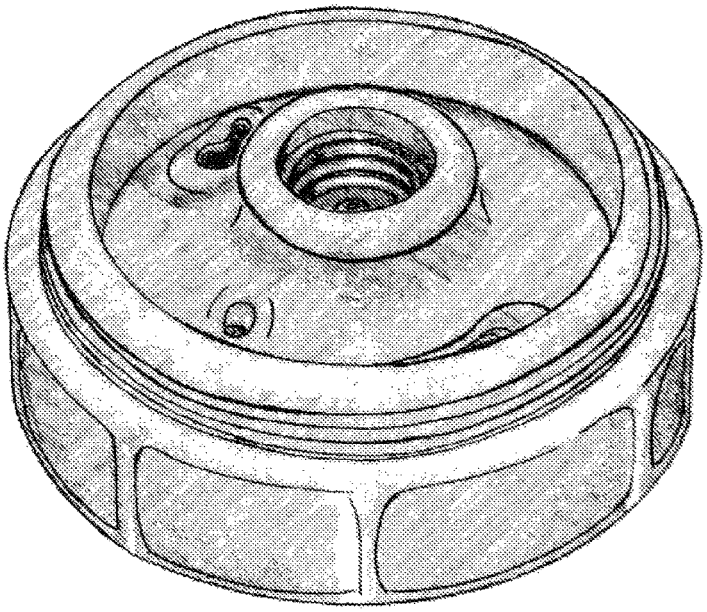

Figure 22
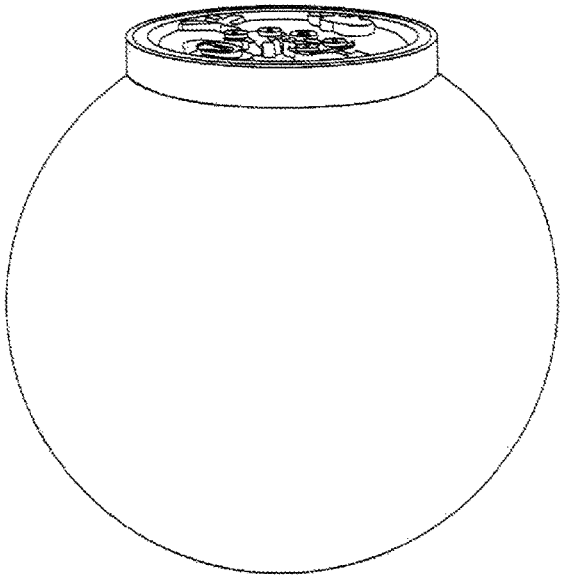
Figure 23
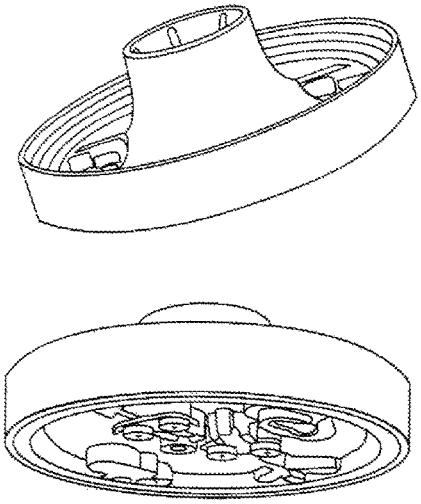
Figure 24

Figure 25
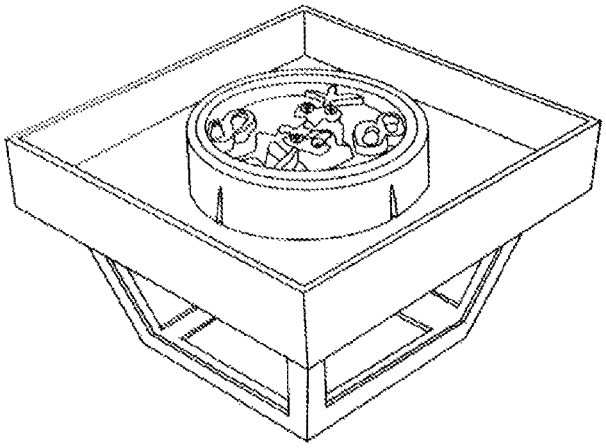
Figure 26
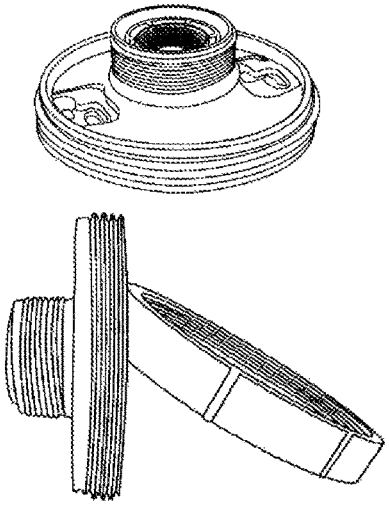
Figure 27

LIGHT FIXTURE APPARATUS

CROSS-REFERENCE TO RELATED APPLICATIONS

This application claims priority to U.S. Provisional patent application Ser. No. 62/310,685 titled "Light Fixture Apparatus", filed on Mar. 19, 2016, and U.S. Provisional patent applications Ser. No. 62/310,741 titled "Light Fixture Apparatus", filed on Mar. 20, 2016 the disclosure of both is herein incorporated by reference in its entirety.

PATENTS CITED

The following documents and references are incorporated by reference in their entirety, Glickman (U.S. Pat. No. 7,628,504), Pearce (U.S. Pat. No. 6,648,488), Howe (U.S. Pat. Appl. No. 2015/0016108), Spearman et al (U.S. Pat. No. 5,664,872), Johnson et al (U.S. Pat. No. 4,565,419), Minissi et al (U.S. Pat. No. 6,250,780), Ratican (U.S. Pat. Appl. No. 2009/0035988) and (U.S. Pat. No. 7,247,049), and Mangin (U.S. Pat. No. 1,769,036).

FIELD OF THE INVENTION

The present invention relates to an electrical outlet box and light fixture apparatus, system and method, and particularly to an apparatus, system and method for allowing the retrofitting of recessed and non-recessed outlets for lamps, projectors and ceiling fans.

DESCRIPTION OF THE RELATED ART

A significant challenge when upgrading or replacing ceiling light fixtures, is the common need for the hiring of an electrician, since the replacement of the traditional keyless lamp holder light fixture includes the need to deal with live electrical wires. Besides being reasonably scared of electrical shock, many people fear that in connecting/disconnecting cables, they will do something that may lead to fires or other liability. At a minimum, it may cost the hiring of an electrician or otherwise qualified individual. Finally, when hanging a larger fixture, such as a ceiling fan or ceiling projector, in many cases there is the need to similarly remove/replace electrical connections.

There is a need for a keyless lampholder light fixture that allows for safe and efficient replacement/enhancement of a luminary and/or the addition of a ceiling fan/projector without the involvement of an electrician (or someone with similar capabilities/knowledge), in effect, to allow any user to perform the function.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about a keyless lamp holder light fixture, comprising a light bulb socket, one or more electrical household wire connections electrically connected to said light socket, one or more screw attachment points and an upper threaded mechanical component and a lower threaded mechanical component. In another aspect, said upper and lower threaded mechanical components are comprised of external threaded features. In yet another aspect, said upper and lower threaded features further comprise electrical connection points within the threads, said electrical connection points being electrically connected to both said light bulb socket and said one or more electrical household wire connections. In another aspect, said lower threaded mechanical component is comprised of external threaded feature and said upper threaded mechanical component is comprised of an internally threaded feature. In yet another aspect, said upper and lower threaded features further comprise electrical connection points within the threads, said electrical connection points being electrically connected to both said light bulb socket and said one or more electrical household wire connections.

Other features and advantages of the present invention will become apparent upon examining the following detailed description of an embodiment thereof, taken in conjunction with the attached drawings.

BRIEF DESCRIPTION OF THE DRAWINGS

FIGS. 6, 10, 16 and 20 show an internal thread housing coupling to an external thread light fixture, according to an exemplary embodiment of the invention.

FIGS. 22-24 and 28-29 show the components using an internal thread light fixture to make a sealed (air and/or water) lighting fixture, according to an exemplary embodiment of the invention.

FIGS. 25-27 show the components using an internal thread light fixture to make a sealed (air and/or water) lighting fixture, according to an exemplary embodiment of the invention.

Figure 1:
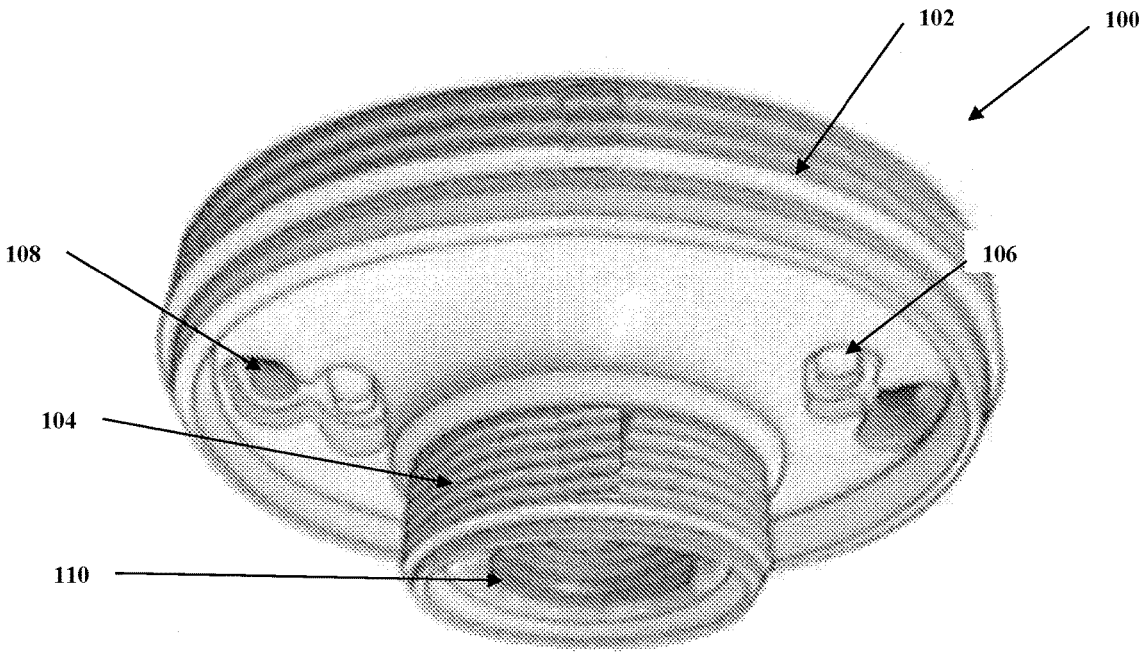
FIGS. 1-2 show illustrations of two light external thread proposed light fixture concepts, according to exemplary embodiments of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Figure 2:
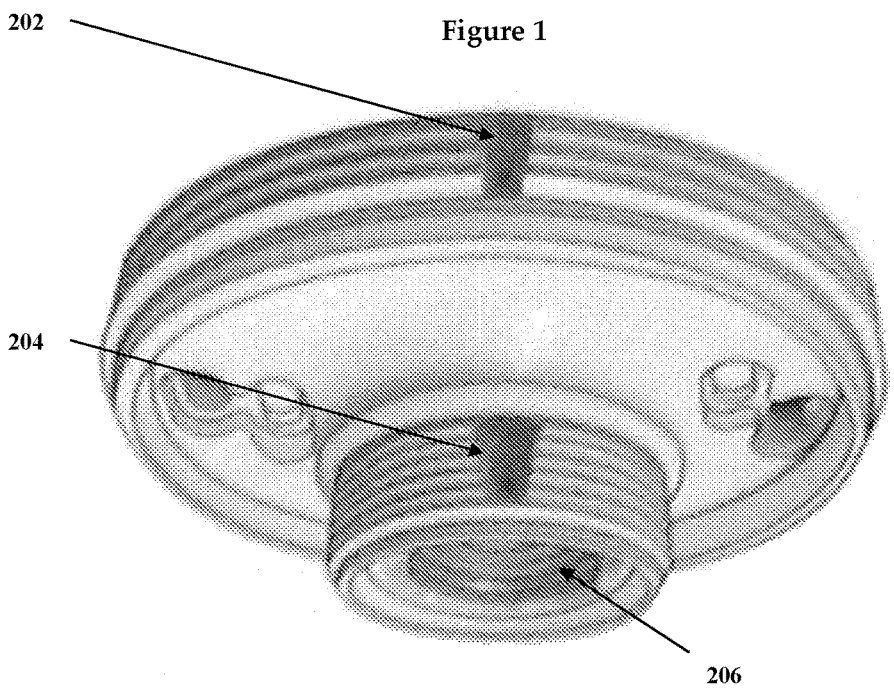
Figure 3:
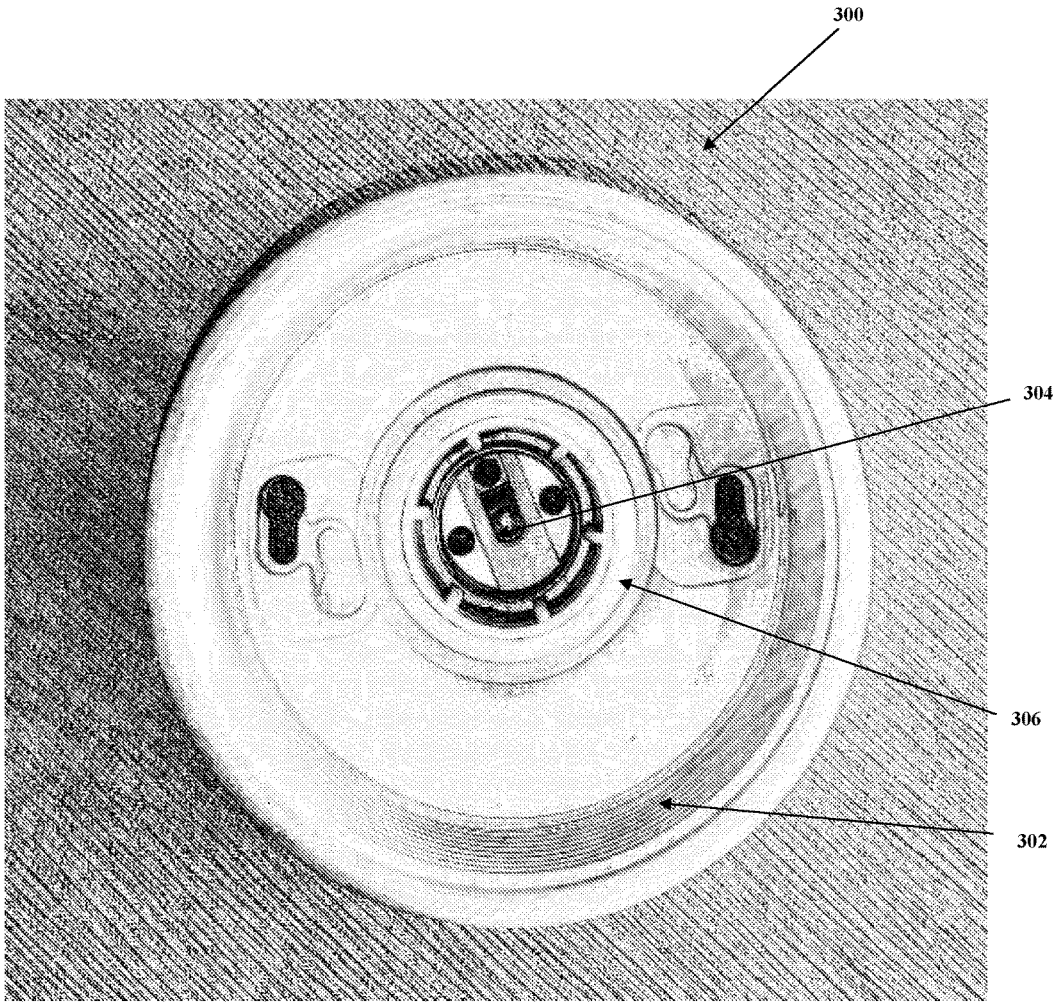
FIGS. 3, 12 and 13 show illustrations of an internal thread light fixture, according to an exemplary embodiment of the invention.

Referring to FIGS. 1-3 we see illustrative embodiments having the primary inventive components of the proposed keyless light holder light fixture concepts and the devices connected to them. In one embodiment, the keyless light holder light fixture body 100 (also called an outlet box mount) of the light fixture has two threaded components, an externally threaded upper one 102 and an externally threaded lower one 104. In an alternate embodiment, the upper thread may be internally threaded with a pressure fitting cap 302, with the lower thread 104 covered by a threaded insert. In one embodiment, the unit 100 may be attached to a traditional juncture box via one or more of the well known screw attachment points 106, 108. In that case, the original installer makes the well known A/C or D/C electrical cable connection inside the juncture box (by connecting the appropriate power, return and ground cables).

In another embodiment, the fixture goes into a matching thread juncture box, which is either retrofitted or originally inserted into the ceiling. The light bulb opening 110 is at the bottom, electrically connected to the household wire connections 1802 and to the connection points 202, 204. The proposed recessed connection points 202, 204 represent improvements over the state of the art. These would be electrically connected to the same points as the light bulb thread 206 and base 304 (where the light bulb usually sits).

As we see in FIG. 2, one or more recessed connection points 202, 204 inside the thread frame may be provided. That way, when (FIG. 4) when the house lighting fixtures 408 are replaced or upgraded, the job does not require an electrician to modify the light fixture 100. The installer simply removes the light bulb or previous lighting fixture, then proceeds to screw on to the fixture the cover 402 which has the complementary plugs and power wiring 404, 406 built into its internal thread structure (as a clip or protuberance that nestles into the connection point recess (202, 204) as the unit is screwed in. In one embodiment, the matching threads within the fixture cover 402 have extended prongs, so that as the cover screws on, said plugs match the receded thread seats (indicating the proper position via a click) and connect the circuit, so that the user simply turns the circuit power on/off energizing the figure. The fixture cover 402 may have the wiring and support for the light fixture built into in, so that the primary mechanical support comes from the upper thread 102, with the electrical connection being either on the rim 202/204, or alternatively 602 done by the inside of the cover 402 going into the light bulb socket 110 opening to make electrical contact.

Figure 4:
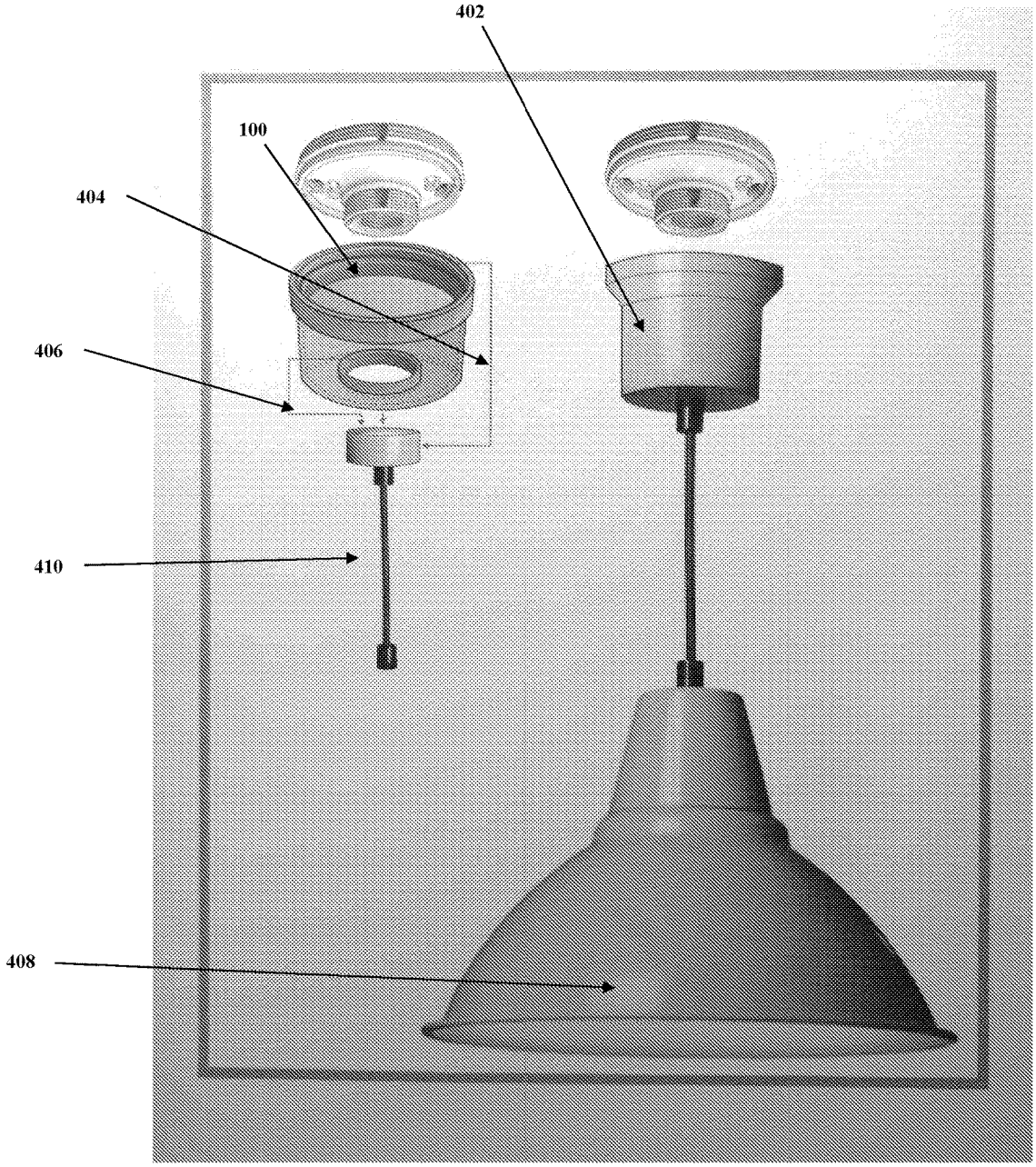
FIG. 4 shows the coupler adapter for an external thread light fixture, according to an exemplary embodiment of the invention.

The upper and/or lower threads provide the fixture with the mechanical support to hold a chandelier, projector, ceiling fan or other similar fixtures. As shown in FIG. 4, the thread connector allows for the easy mount and electrical connection. In an alternate embodiment, the lower electrical connection is a separate unit 410.

Figure 5:
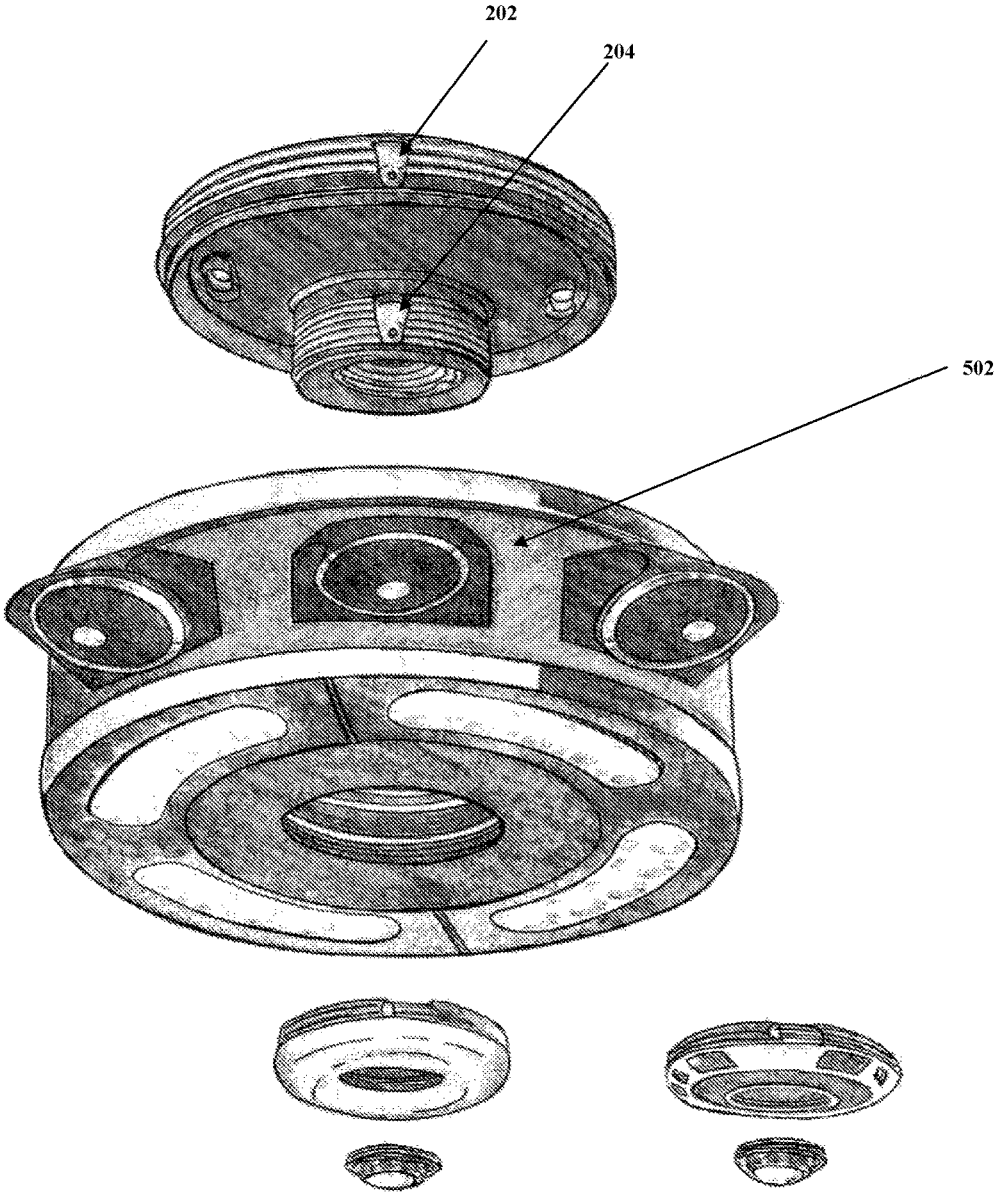
FIG. 5 shows a proposed light fixture coupling to an external thread light fixture, according to an exemplary embodiment of the invention.
Figure 6:
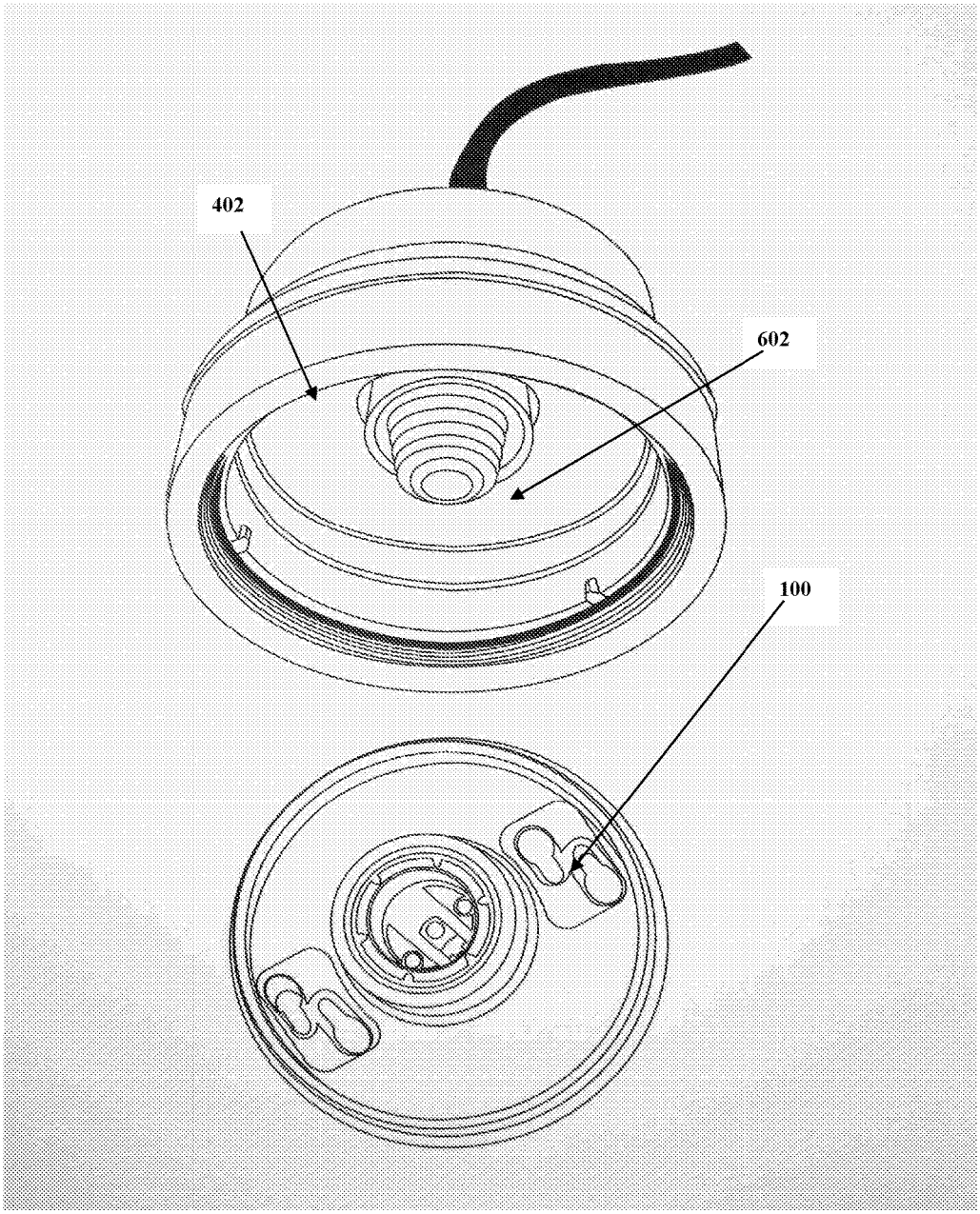

In an alternate embodiment, the upper and/or lower threads are similarly used without the addition of the recessed power connection, instead the light bulb fixture 100 is used (FIG. 5) to connect a lighting fixture, sound system, projector or other such fixture 502 to the recessed connection points 202, 204.

Figure 7:
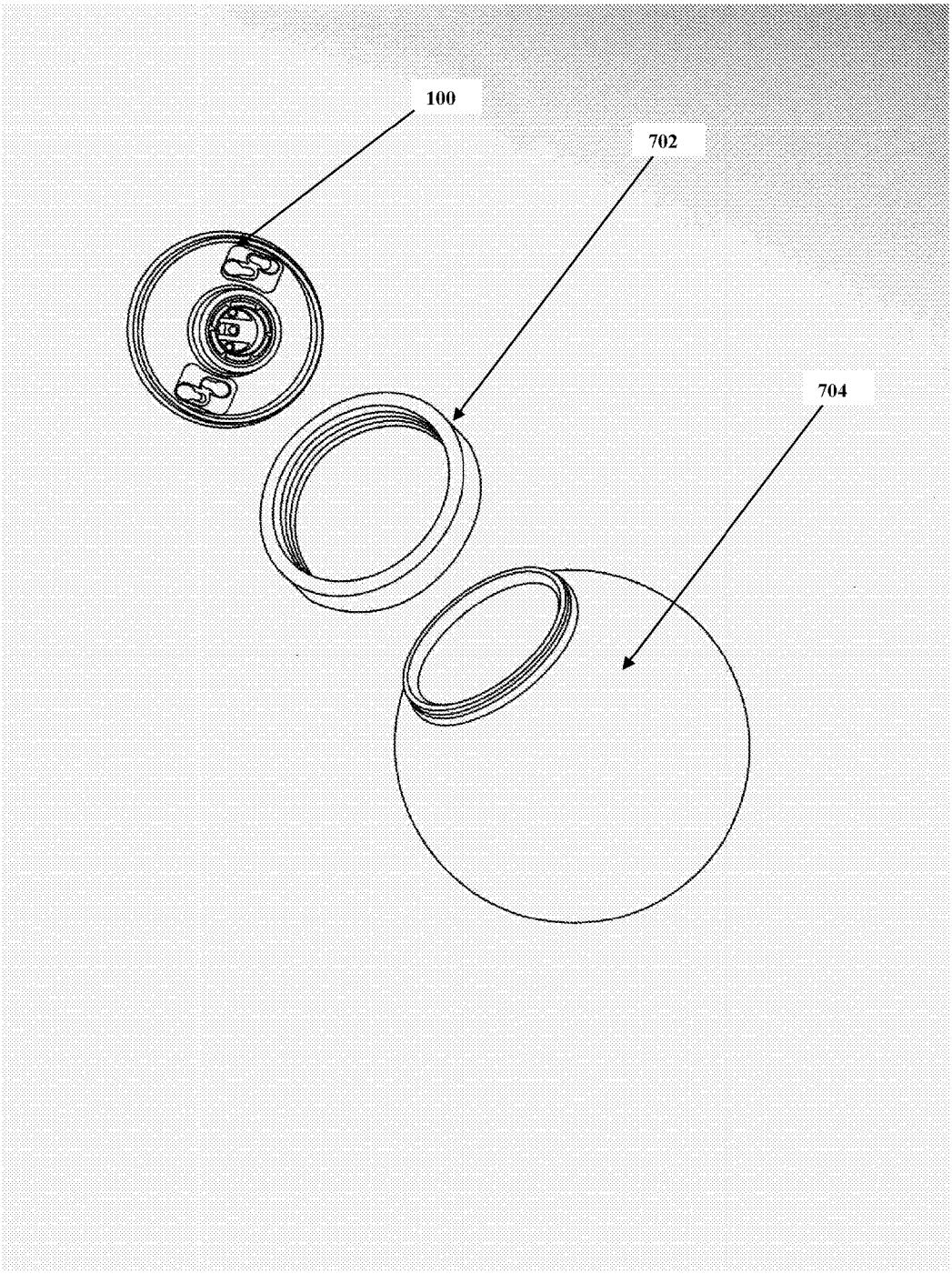
FIGS. 7-9 show light fixture couplings to bulb housing units, according to exemplary embodiments of the invention.
Figure 8:
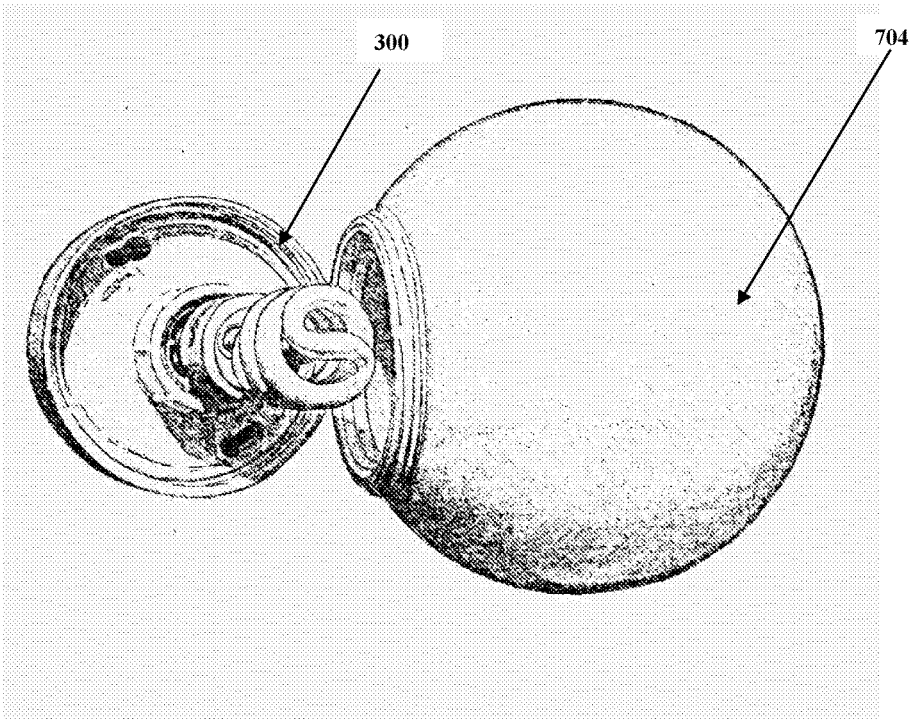
Figure 9:
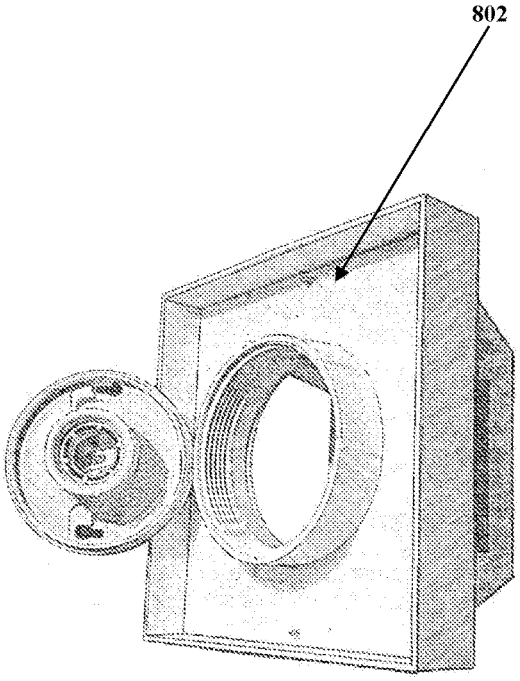

FIG. 7 illustrates how the light fixture 100 may be coupled through a thread ring 702 to a lighting fixture housing 704. Alternatively, an internal thread light fixture 300 houses the lighting fixture housing 704. In another embodiment, the fixture 100 goes into the fixture 902. The light fixtures 704, 902 may be sealed to both air and/or water.

Figure 10:
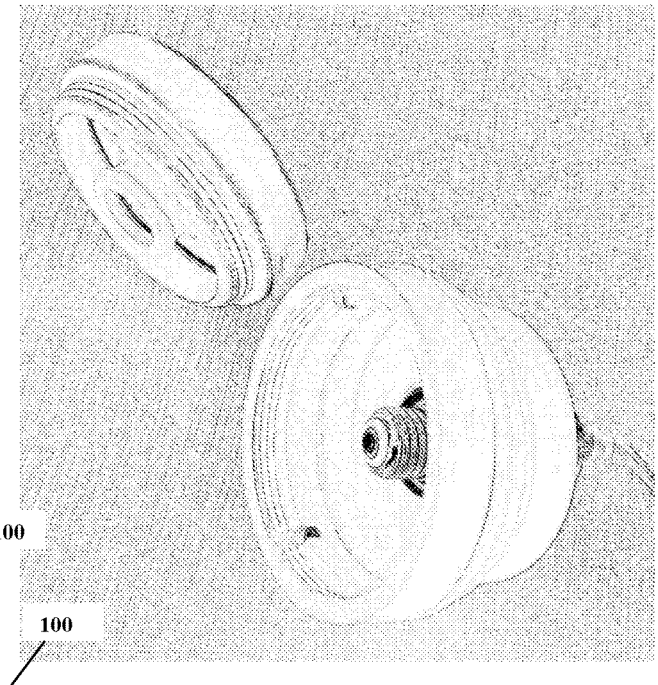
Figure 11:
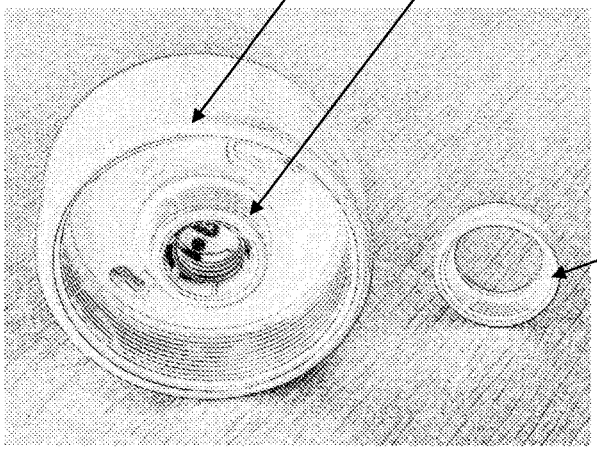
FIG. 11 shows a housing ring pressure fitting of the external thread light fixture, according to an exemplary embodiment of the invention.
Figures 12, 13:
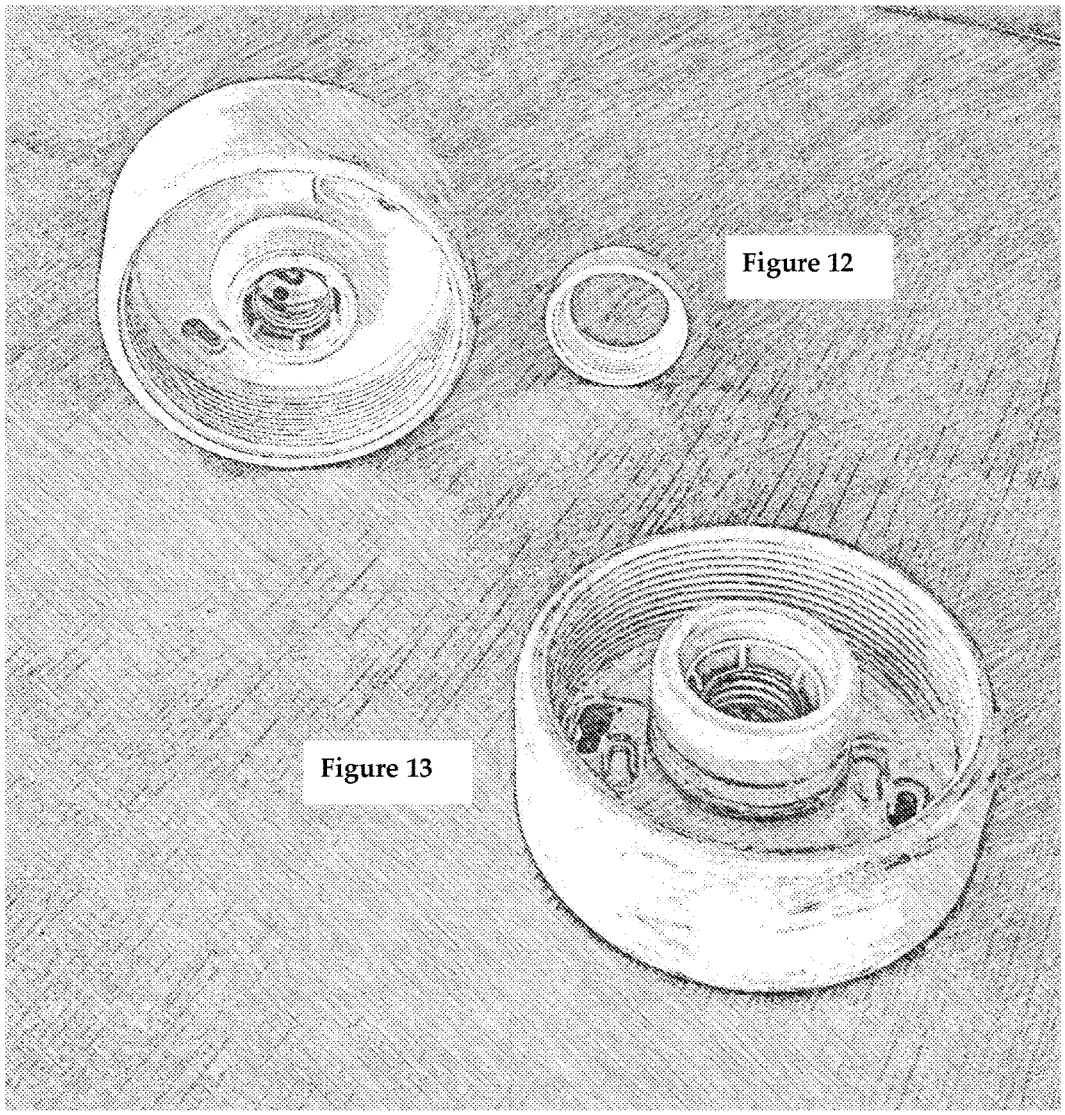
Figure 14:
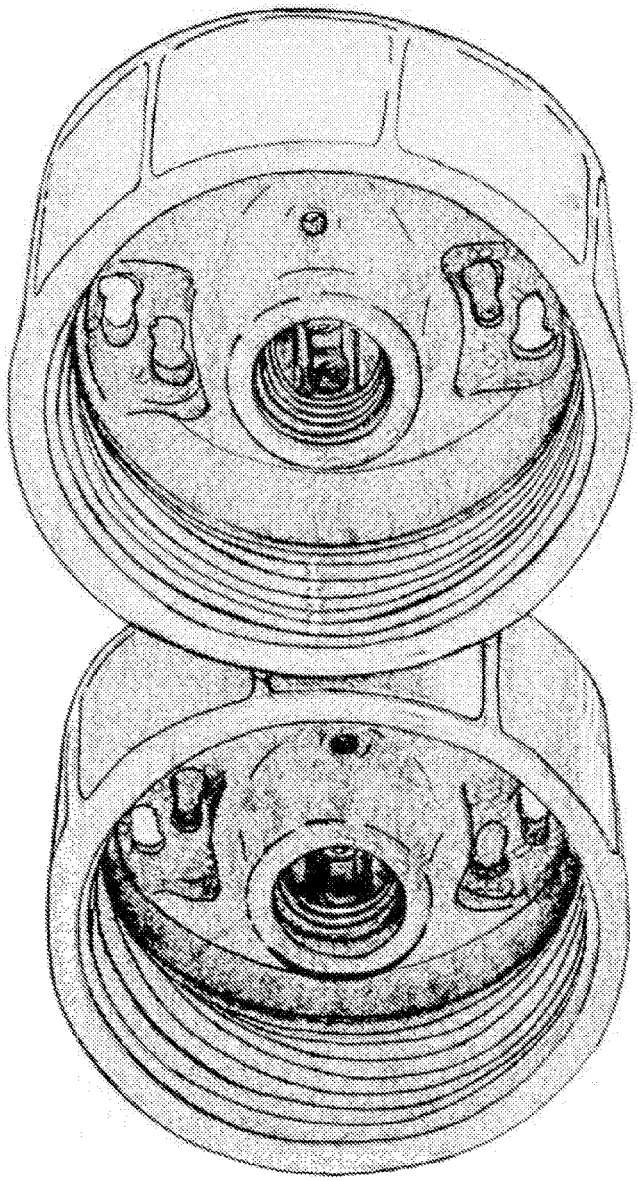
FIG. 14 shows both an internal thread (top) and housing ring pressure fitting (bottom) of the external thread light fixture, according to exemplary embodiments of the invention.
Figure 15:
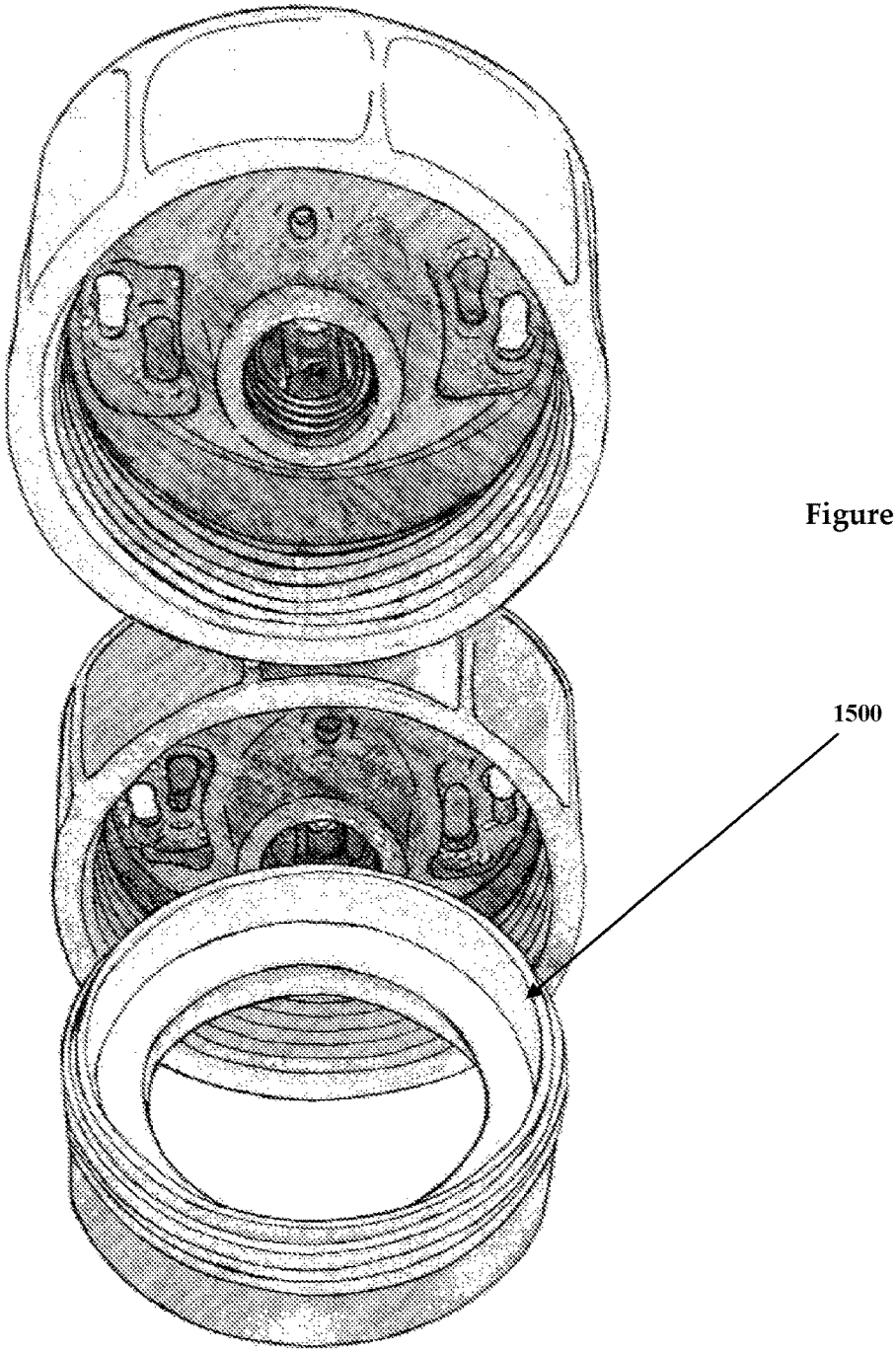
FIG. 15 shows the components of the housing ring pressure fitting of the external thread light fixture, according to an exemplary embodiment of the invention.
Figure 17:
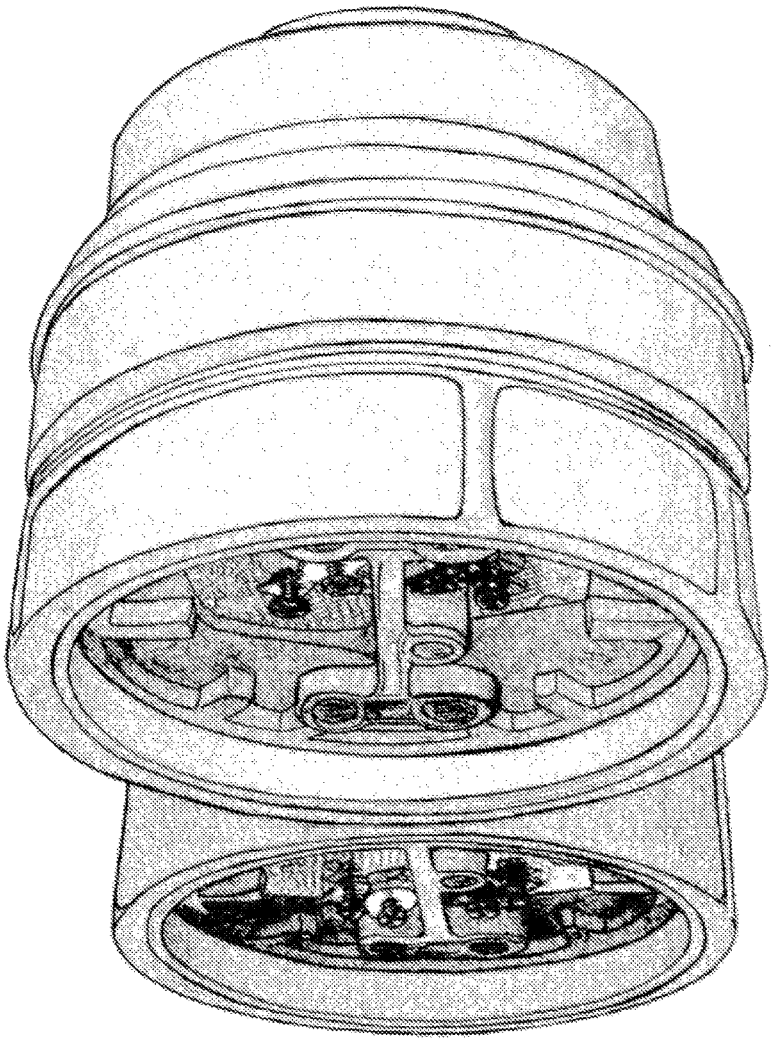
FIG. 17 shows an integral housing with built in light components, according to an exemplary embodiment of the invention.
Figure 18:
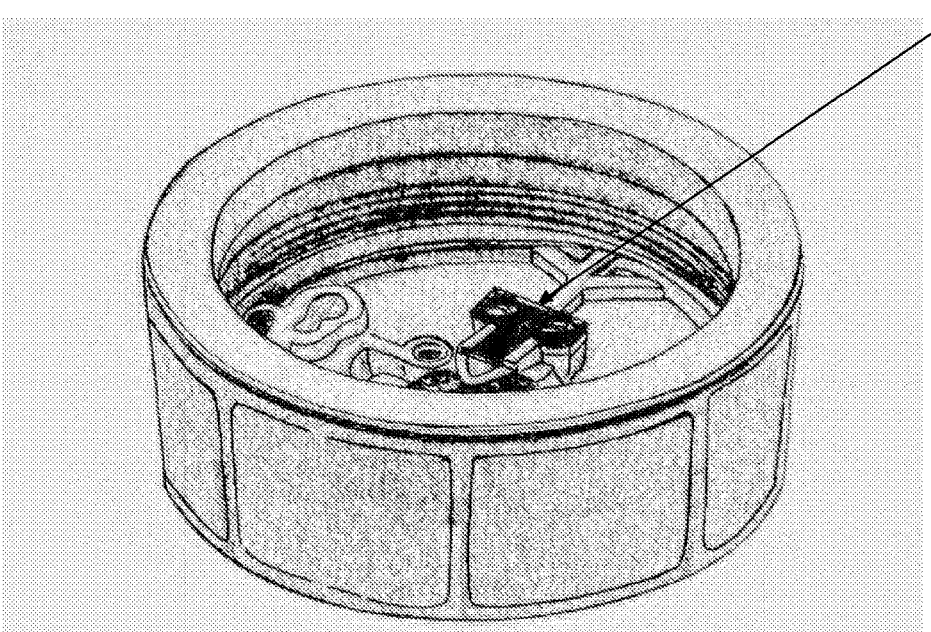
FIG. 18 shows the top (ceiling portion) view of a light fixture, from which the power is connected to the traditional house wires, according to an exemplary embodiment of the invention.
Figure 19:
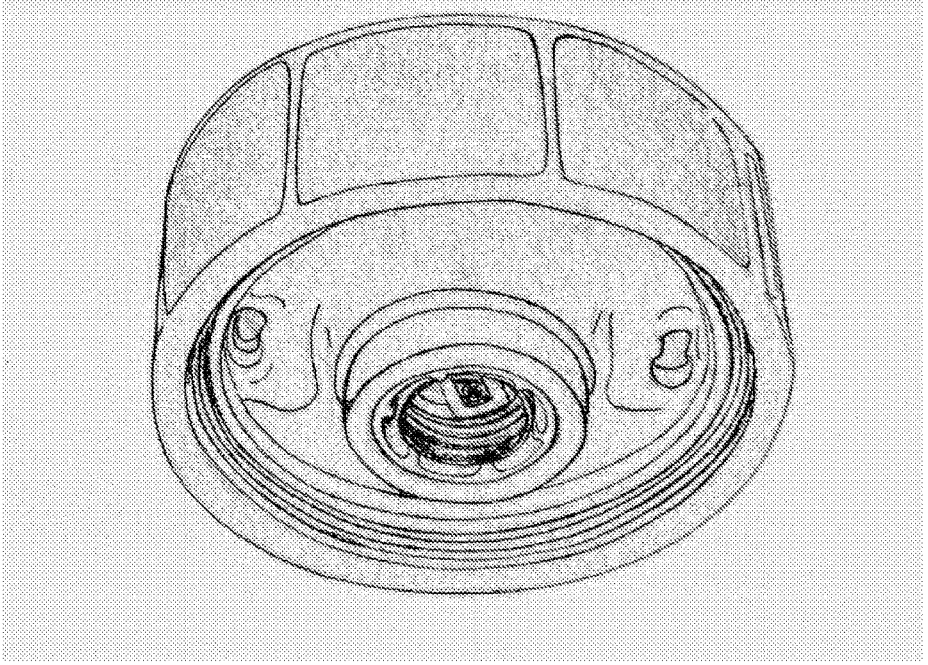
FIG. 19 shows the bottom view of the light fixture, according to an exemplary embodiment of the invention.
Figure 20:
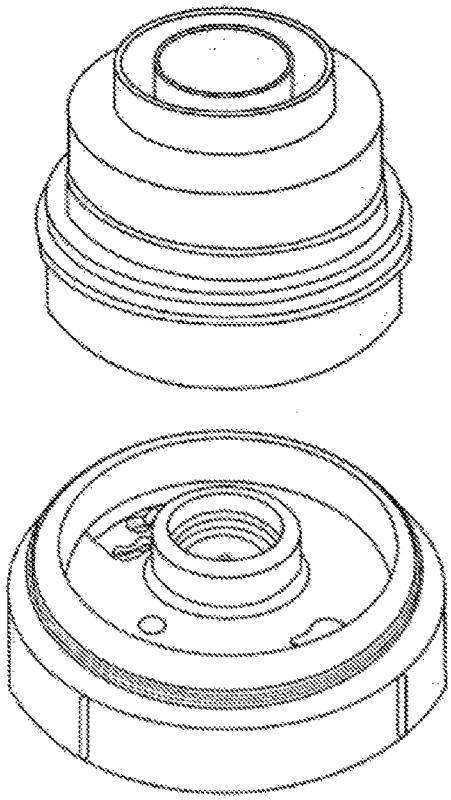
Figure 21:
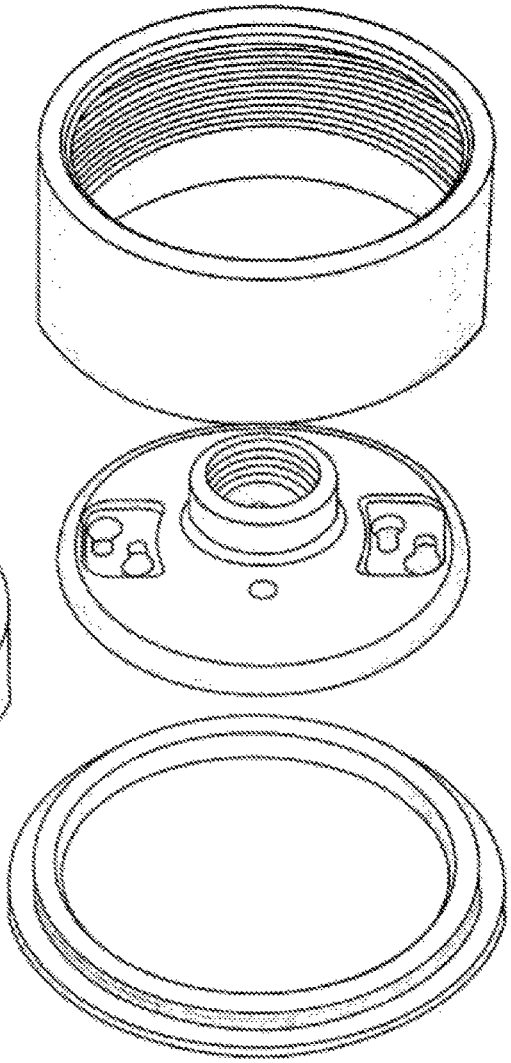
FIG. 21 shows a housing jig useful in converting a traditional light fixture to the new type having an internal thread, according to an exemplary embodiment of the invention.
Figure 28:
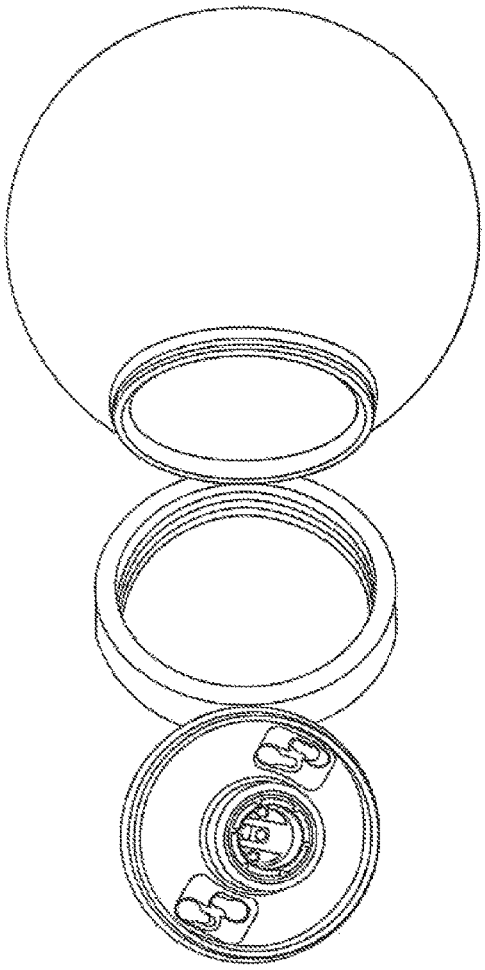
Figure 29:
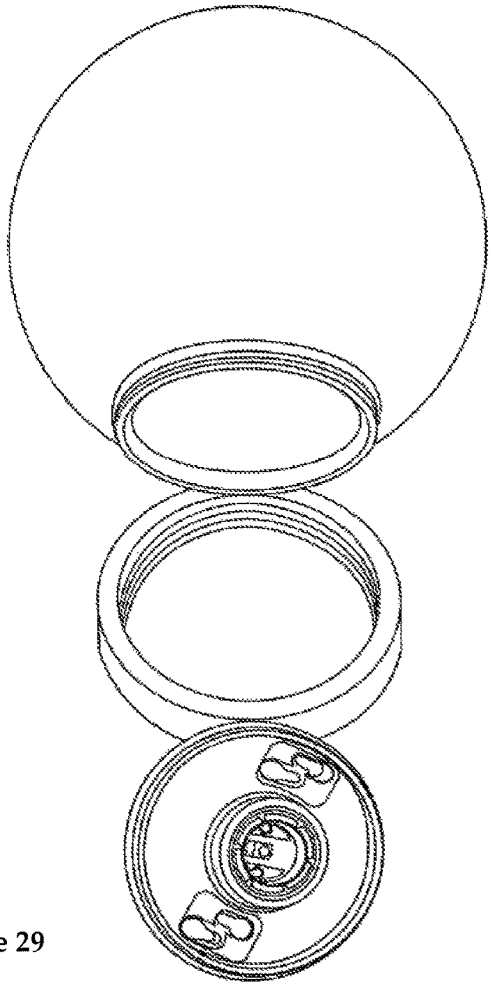
Figure 30:
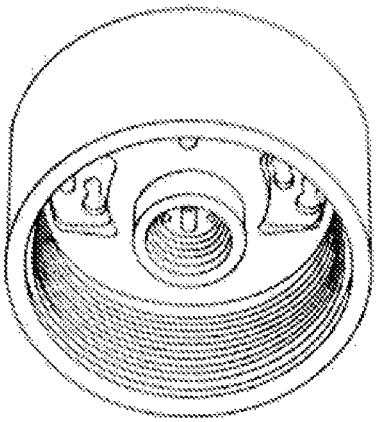
FIGS. 30-33 show the four major types of light fixtures possible with the new system, according to an exemplary embodiment of the invention.
Figure 31:
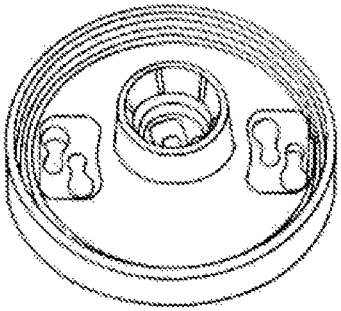
Figure 32:
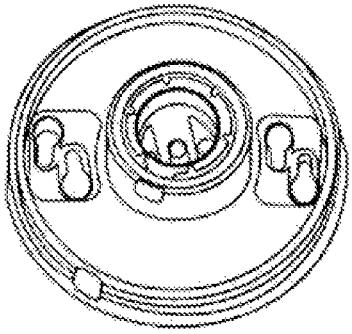
Figure 33:
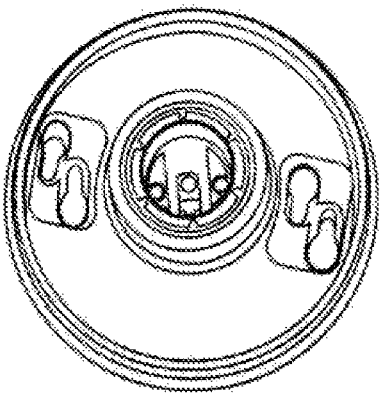

FIG. 10 illustrates an alternative embodiment, where a housing ring 1100 houses the light fixture 100 which remains in place through the threading of the pressure fitting cap 306 and/or a ring 1500.

The units may be manufactured of a number of materials, including ceramic, as well as polymers, plastics and thermoplastics. These include such well-known materials as nylon, ABS ("acrylonitrile butadiene styrene") or other such moldable plastics. Some other potential materials include aromatic and semi-aromatic advanced materials such as Primospire®, Torion®, AvaSpire® and Amodel®. PrimoSpire is a polyphenylene (SRP) thermoplastic, Torlon® is a high performance amorphous (non-crystalline) engineering thermoplastic, a polyamide-imide (PAI).

AvaSpire® is a versatile family of polyaryletherketones (PAEK), PAEK is an advanced thermoplastic resin having both ether and ketone linkages in its chains. PAEK materials are semicrystalline aromatic polyesters with excellent mechanical and dielectric properties. Amodel® is a semi-aromatic polyamide (PPA) that delivers significantly higher performance than typical nylons. PPAs are a semi-crystalline, aromatic polyamide. Compared to nylon 6/6, it is stronger, stiffer, less sensitive to moisture, and has higher thermal capabilities.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

The invention claimed is:

1. A single body lamp holder light fixture, said light fixture comprising:

a single fixture body having a light bulb socket at a first end;

one or more electrical household wire connectors at a fixture body second end, said connectors electrically connected to said light bulb socket;

one or more screw attachment points along said fixture body; and an upper threaded mechanical component along the periphery of said fixture body second end and a lower threaded mechanical component along the periphery of said fixture first end.

2. The keyless lamp holder light fixture of claim 1 wherein;

said upper and lower threaded mechanical components are comprised of external threaded features.

3. The keyless lamp holder light fixture of claim 2 wherein;

said upper and lower threaded features further comprise electrical connection points within the threads, said electrical connection points being electrically connected to both said light bulb socket and said one or more electrical household wire connections.

4. The keyless lamp holder light fixture of claim 1 wherein;

said lower threaded mechanical component is comprised of external threaded feature; and said upper threaded mechanical component is comprised of an internally threaded feature.

5. The keyless lamp holder light fixture of claim 4 wherein;

said upper and lower threaded features further comprise electrical connection points within the threads, said electrical connection points being electrically connected to both said light bulb socket and said one or more electrical household wire connections.

* * * * *